US012246383B1

(12) United States Patent
Chen

(10) Patent No.: US 12,246,383 B1
(45) Date of Patent: Mar. 11, 2025

(54) UNIAXIAL-HOT-PRESSING FOR MAKING NEAR-NET-SHAPE PARTS USING SOLID STRESS TRANSMITTING MEDIA

(71) Applicant: Triad National Security, LLC, Los Alamos, NM (US)

(72) Inventor: Ching-Fong Chen, Los Alamos, NM (US)

(73) Assignee: TRIAD NATIONAL SECURITY, LLC, Los Alamos, NM (US)

( * ) Notice: Subject to any disclaimer, the term of this patent is extended or adjusted under 35 U.S.C. 154(b) by 0 days.

(21) Appl. No.: 17/947,513

(22) Filed: Sep. 19, 2022

Related U.S. Application Data

(60) Provisional application No. 63/252,346, filed on Oct. 5, 2021.

(51) Int. Cl.
*B22F 3/03* (2006.01)
*B22F 3/02* (2006.01)
*B22F 5/10* (2006.01)

(52) U.S. Cl.
CPC ..... *B22F 3/03* (2013.01); *B22F 5/10* (2013.01); *B22F 2003/026* (2013.01)

(58) Field of Classification Search
CPC ..... B22F 3/03; B22F 2003/031; B22F 2003/026; B22F 3/001
See application file for complete search history.

(56) References Cited

U.S. PATENT DOCUMENTS 3,116,137 A * 12/1963 Vasilos ..... C03B 19/066 501/133
3,914,371 A * 10/1975 Benton ..... C04B 35/563 501/87
4,590,780 A * 5/1986 Bachmann ..... B21K 1/761 72/328
4,657,754 A * 4/1987 Bauer ..... C01F 7/441 423/625
2002/0106298 A1* 8/2002 Allroth ..... B22F 3/087 419/38

OTHER PUBLICATIONS

German (Sintering: from empirical observations to scientific principles. Butterworth-Heinemann, 2014) (Year: 2014).*
Bariteworld ("Flake Graphite", Snapshot from Sep. 18, 2018). (Year: 2018).*
Olevsky et al. ("Densification of porous bodies in a granular pressure-transmitting medium" Acta Materialia 55. 2007 1351-1366.) (Year: 2007).*
Randall M. German, "Chapter 10: Sintering with External Pressure," Sintering: From Empirical Observations to Scientific Principles, 305-354, (2014).

* cited by examiner

*Primary Examiner* — Ricardo D Morales
(74) *Attorney, Agent, or Firm* — Alston & Bird LLP

(57) ABSTRACT

Embodiments provide for a method of manufacturing a part. In example embodiments, the method includes positioning a material within a cavity of a die, positioning solid lubricant within the cavity of the die between a surface of a plunging component and the material, and uniaxially applying pressure to the material with the plunging component via the solid lubricant until the material forms a desired shape.

25 Claims, 17 Drawing Sheets

100

300

UNIAXIAL-HOT-PRESSING FOR MAKING NEAR-NET-SHAPE PARTS USING SOLID STRESS TRANSMITTING MEDIA

CROSS-REFERENCE TO RELATED APPLICATIONS

The present application claims priority to U.S. Provisional Application Ser. No. 63/252,346, titled "UNIAXIAL-HOT-PRESSING FOR MAKING NEAR-NET-SHAPE PARTS USING SOLID STRESS TRANSMITTING MEDIA," filed Oct. 5, 2021, the contents of which are incorporated herein by reference in their entirety.

BACKGROUND

Hot pressing of ceramic and metal powders has been used to produce a wide variety of advanced ceramics and metals that require high density and high strength. Hot pressing operations supply thermal energy under high pressure that is needed to transform powder materials into a wide variety of commodities and end-use consumer products. If the external pressure is uniaxially applied from top and bottom, then it is referred to as uniaxial hot pressing. Unfortunately, conventional uniaxial hot pressing technology can only produce parts with simple geometric shapes, such as discs, cylinders, cubes, rectangular blocks because it only provides the unidirectional pressing (e.g., up and down) without lateral (e.g., side) pressing. If conventional uniaxial hot pressing technology is used to make complicated shapes, the uniaxial hot pressed complicated shape results in cracking, non-uniform density or low density area due to the non-uniform stress distribution by the solid graphite punch. The major reason for these issues is because the solid graphite punch used in uniaxial hot pressing is rigid. The rigid graphite punch is uniaxially pressed, therefore it causes non-uniform applied stress at various locations.

Although hot-isostatic-pressing had been developed to isostatically hot press ceramic or metal powders, it relies on gas pressure instead of solid graphite media. Furthermore, hot-isostatic-pressing using gas pressure can only be applied to consolidated parts with closed pore structures. If raw powder or parts with open pores are hot-isostatic-pressed, the high pressure gas penetrates into the open pores and reaches equilibrium with the external applied gas pressure. When this equilibrium is reached, there is no external pressure to close the pores. To overcome this open pore issue, some researchers have used a metal can to enclose the raw powder or the part with open pore followed by a gas hot-isostatic-pressing. The metal can serve to the close barrier so that the external gas pressure can be applied to the metal, which then transmits the pressure to the part inside the metal can to close the pores of the powder or part during gas hot-isostatic-pressing. Some researchers have also buried the raw powder or open pore part with some ceramic or metal powder to assist the metal can in transmitting the gas pressure. Unfortunately, for hot-isostatic-pressing at very high temperatures, metals with higher melting points must be used. Metals with higher melting points are very brittle and cannot be deformed easily (e.g., Zirconium, Vanadium, Hafnium, Technetium, Boron, Niobium, Molybdenum, Tantalum, Tungsten). Other metals with higher melting point are precious metals and are extremely expensive (e.g., including Rhodium, Ruthenium, Iridium, Osmium, and Rhenium).

The inventors have identified a number of deficiencies and problems associated with existing hot pressing systems and methodologies. Through applied effort, ingenuity, and innovation, many of these identified problems have been solved by developing solutions that are included in embodiments of the present disclosure, many examples of which are described in detail herein.

SUMMARY

Embodiments herein are directed to uniaxial hot pressing using graphite flake or hexagonal boron nitride to achieve a pseudo-isostatic-hot-pressing. Embodiments herein minimize the energy consumption and material waste caused by the extensive machining of a simple blank shape. Embodiments herein further provide an advanced manufacturing technology that can deliver higher quality components with a faster production rate.

Embodiments provide for a method of manufacturing a part. In example embodiments, a method includes positioning a material within a cavity of a die, positioning solid lubricant within the cavity of the die between a surface of a plunging component and the material, and uniaxially applying pressure to the material with the plunging component via the solid lubricant until the material forms a desired shape.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Figure 1:
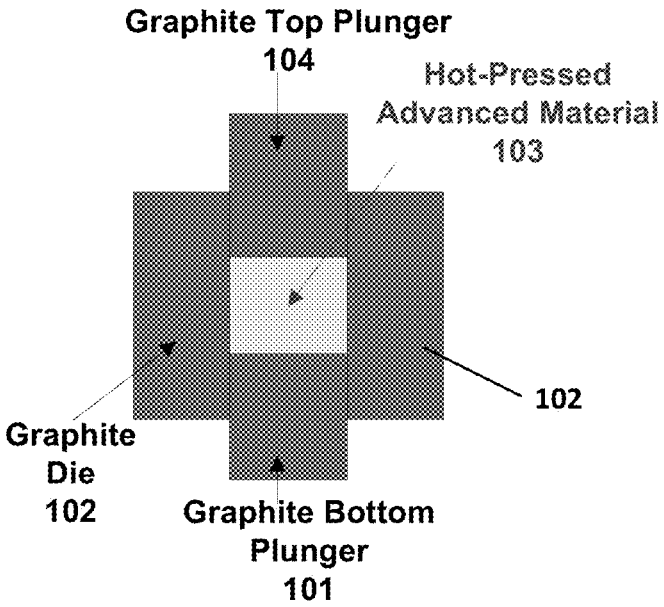

Having thus described the disclosure in general terms, reference will now be made to the accompanying drawings, which are not necessarily drawn to scale, and wherein:

FIG. 1 depicts a conventional uniaxial hot pressing method to manufacture a simple shape part.

Figure 2:
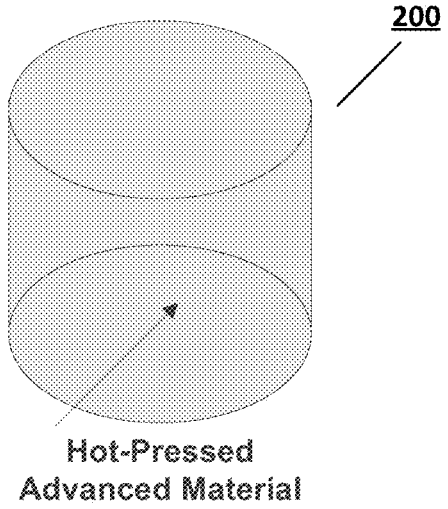
Figure 2:
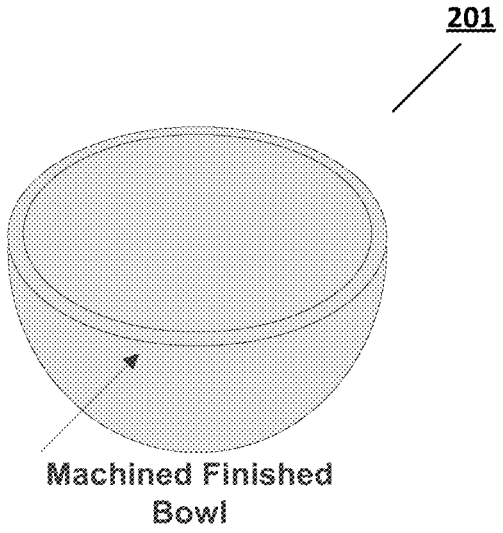

FIG. 2 depicts an example right cylinder formed first followed by machining to achieve a mortar shape final component, where a majority of the right cylinder was removed in order to achieve a thin wall component.

Figure 3:
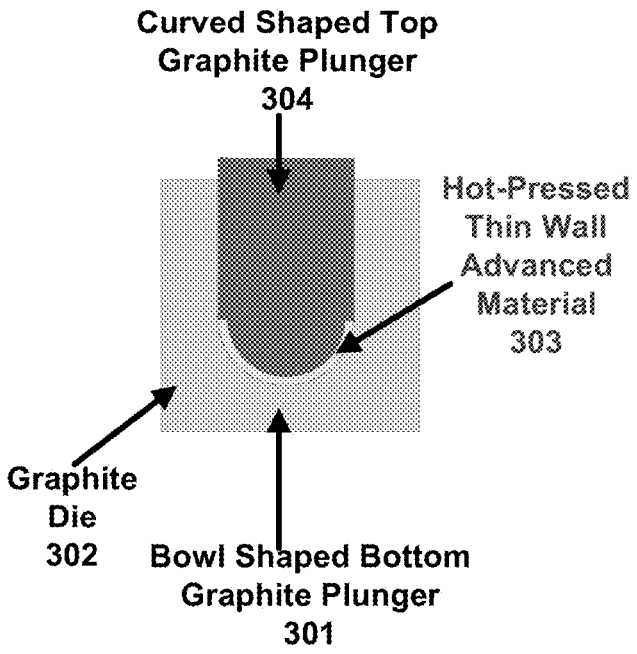

FIG. 3 depicts an example convex/curved top plunger and mortar shaped bottom plunger.

Figure 4:
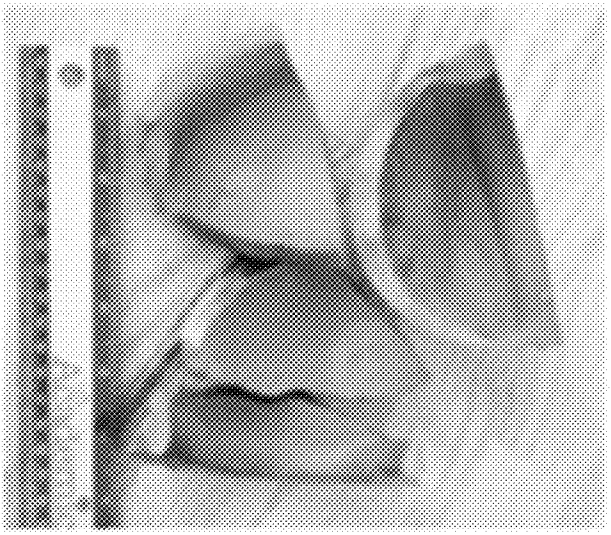

FIG. 4 depicts a typical ceramic mortar with cracked or broken pieces.

Figure 5:
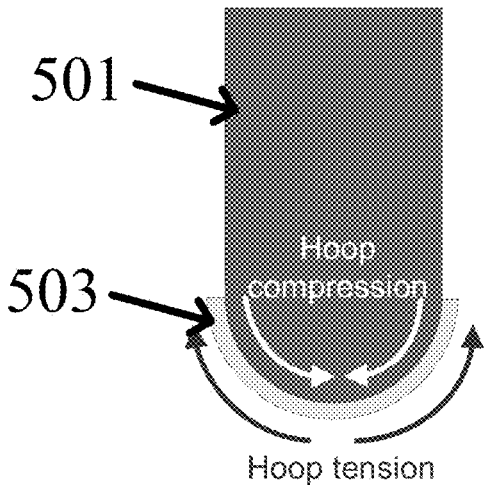

FIG. 5 depicts an example mechanism for the cracking or breaking as depicted in FIG. 4.

FIGS. 6A, 6B, 6C, 6D, 6E, 6F, and 6G depict example uniaxial hot pressing incorporating a graphite flake in place of a rigid graphite plunger, according to embodiments of the present disclosure.

Figure 7:
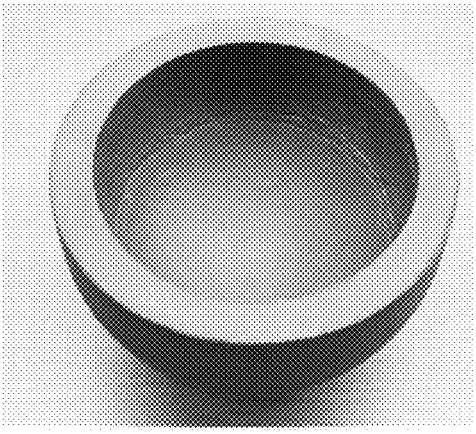

FIG. 7 depicts a mortar, manufactured in accordance with embodiments herein, that is free from cracks or other defects.

Figure 8:
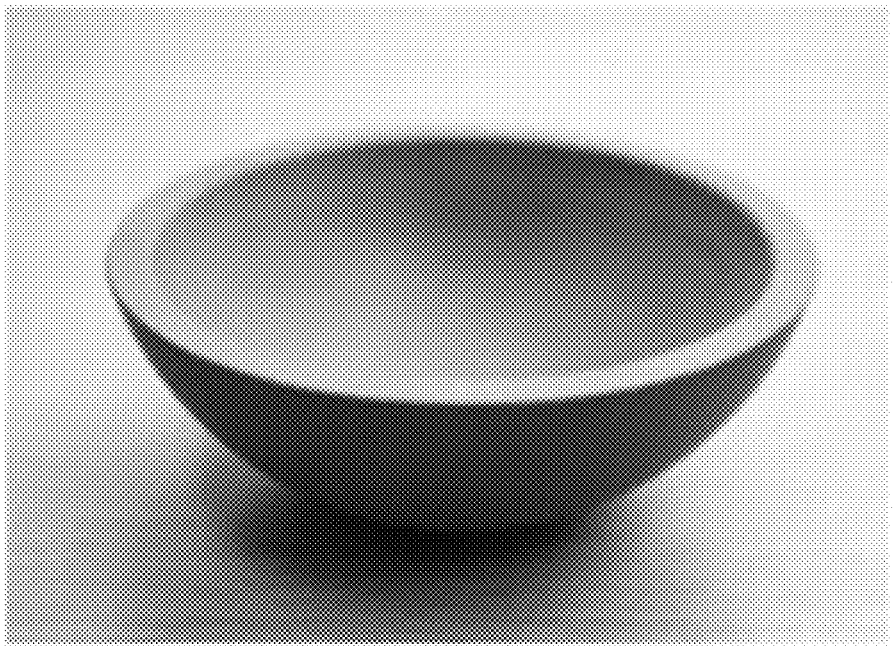

FIG. 8 depicts another mortar, manufactured in accordance with embodiments herein, that is free from cracks or other defects.

Figure 9:
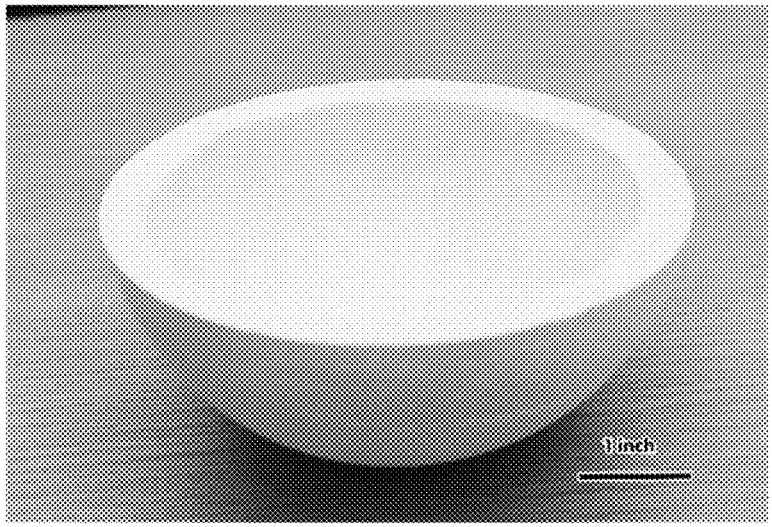

FIG. 9 depicts an aluminum oxide mortar, manufactured in accordance with embodiments herein, that is free from cracks or other defects.

Figure 10:
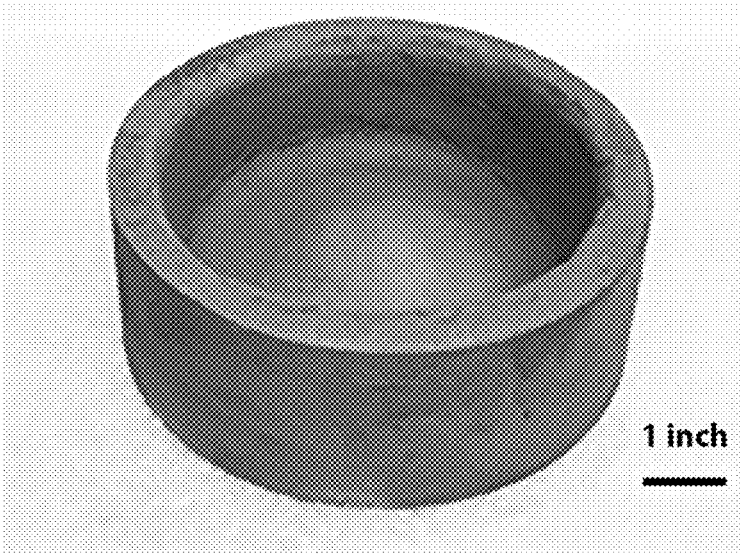

FIG. 10 depicts a silicon carbide crucible, manufactured in accordance with embodiments herein, that is free from cracks or other defects.

Figure 11:
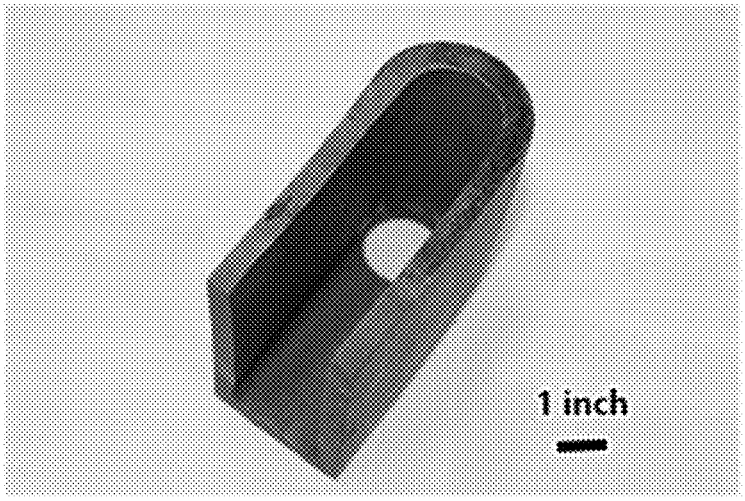

FIG. 11 depicts a zirconium carbide heat shield, manufactured in accordance with embodiments herein, that is free from cracks or other defects.

DETAILED DESCRIPTION

Various embodiments of the present disclosure now will be described more fully hereinafter with reference to the accompanying drawings, in which some, but not all embodiments of the disclosure are shown. Indeed, the disclosure may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. Like numbers refer to like elements throughout.

To avoid using gas hot-isostatic-pressing and to improve the stress distribution during uniaxial hot pressing, embodiments herein use graphite flake or hexagonal boron nitride powder to replace the solid graphite punch used in conventional hot pressing. The graphite flakes or hexagonal boron nitrides (e.g., or other appropriate solid lubricant) can easily slide relative to each other enabling the redistribution or substantial uniform distribution of stress from high-pressure areas to low-pressure areas. The resulting substantially uniform pressure is very similar to an isostatic pressing. Hence, embodiments herein may be referred to as pseudo-isostatic-pressing that can produce a revolutionary breakthrough to the ceramic and metal industries for making complicated near-net-shape. This near-net-shape pseudo-isostatic-hot-pressing technology enables production of high density parts with improved density distribution throughout the whole part compared to that of parts produced using a solid rigid graphite punch. The near-net-shape technology can minimize the tedious and energy intensive machining work, which can save machining time and reduce footprint. By minimizing the machining work, the production rate can be increased while minimizing waste generation. This may save energy and resources (e.g., diamond grinding wheels). while reducing the rejection rate of parts thereby increasing the production yield.

Embodiments herein are directed to uniaxial hot pressing using graphite flake or hexagonal boron nitride to achieve a pseudo-isostatic-hot-pressing result. That is, embodiments herein achieve results akin to those that may otherwise only be achievable using hot-isostatic-pressing, by employing graphite flake or hexagonal boron nitride (e.g., a solid lubricant) in place of a rigid plunger in uniaxial hot pressing. Embodiments herein minimize energy consumption and material waste caused by the extensive machining of a simple blank shape. Embodiments herein further provide an advanced manufacturing technology that can deliver higher quality components with a faster production rate.

Embodiments herein provide for uniformly distributing force to form a part by using solid lubricant (e.g., graphite flake, hexagonal boron nitride, or the like) as the pressure transmitting material in order to form a part (e.g., a mortar, or the like) having a substantially uniform density. A part having a substantially uniform density is less likely to have cracks or defects caused by having been formed without uniformly distributed force applied to it.

Embodiments herein are described with reference to graphite flakes or hexagonal boron nitride, as examples of solid lubricants for use in embodiments herein. It will be appreciated that other solid lubricants may be used without departing from the scope of the present disclosure. Flakes, as described herein, may be associated with sizes ranging from 10 micron to 1 centimeter, although flakes of other sizes may be used without departing from the scope of the present disclosure.

FIG. 1 depicts an example of conventional uniaxial hot pressing system 100. As shown in FIG. 1, a bottom graphite punch or plunger 101 is inserted into the graphite die 102. Ceramic or metal powder 103 is loaded into the cavity above the graphite bottom plunger 101 and inside the cavity that make up graphite die 102. A top graphite punch or plunger 104 is then loaded into the graphite die 102 (e.g., into the cavity of the graphite die 102) until it touches or otherwise comes in contact with the ceramic or metal powder 103. The entire assembly 100 is then loaded into a uniaxial hot press furnace to be hot pressed at a high temperature and a high pressure to achieve a component with simple shape.

FIG. 2 shows a right cylinder 200 formed first followed by machining to achieve a mortar shape final component 201. The majority of the right cylinder 200 was removed in order to achieve a thin wall component 201. In FIG. 2, an example simple shape part 200 (e.g., the right cylinder) results from being hot pressed using an example conventional uniaxial hot pressing system as depicted and described with respect to FIG. 1 (e.g., using a rigid plunger 101). To achieve a thin-wall mortar, an energy extensive machining must then be performed to remove the majority of the unwanted material from the shape part 200 in order to achieve a final, desired, thin-wall mortar 201. As FIG. 2 indicates, the final thin wall component 201 contains only a small fraction of material from the hot pressed right cylinder 200; thus, a majority of the hot pressed material is wasted or discarded. This is not an efficient technology for multiple reasons, including the additional machining required as well as the waste of resources.

FIG. 3 depicts an example conventional convex/curved top plunger 304 and mortar shaped bottom plunger 301. With reference to FIG. 3, a near-net-shape hot pressing system 300 has been attempted in order to minimize the machining time, cost, and energy, while also delivering a higher quality product to customers with a faster production rate. Near-net-shape refers to a result of the system being in near final condition, possibly eliminating extensive machining to achieve the near final condition (e.g., near net shape is a term given to processes that aim for the initial fabrication of a component to be close in size and shape to the finished product). The near-net-shape hot pressing system in FIG. 3 involves uniaxial hot pressing a thin-wall mortar 303 using a curved graphite plunger 304, as shown in FIG. 3. That is, in FIG. 3, a convex/curved shaped top (e.g., graphite) plunger 304 is used in conjunction with a bowl (e.g., concaved/mortar) shaped bottom (e.g., graphite) plunger 301. This system fails due to the result of a cracked/broken component after ejection out of the graphite die 302. FIG. 4 depicts an example ceramic mortar with cracked or broken pieces associated with defects introduced as a result of the conventional hot pressing system by which the ceramic mortar was manufactured. The reason for the cracking is associated with a coefficient of thermal expansion (CTE) mismatch between the convex/curved graphite plunger 304 and the surrounding hot pressed material 303, which creates stress in the part 303 (e.g., mortar).

FIG. 5 illustrates the mechanism for the cracking that is depicted in FIG. 4 and discussed otherwise herein. Graphite has a very low CTE (~3×10−6/° C.) while most ceramics have a CTE of ~5 to $13\times10^{-6}$/° C. Metal has even higher CTE ranging from ~5 to $25\times10^{-6}$/° C. During the consolidation process at the hot pressing temperature, the mortar 503 is soft and it relieves all of the stress inserted onto the graphite plunger 501. As indicated in FIG. 5, during cooling after the end of the hot pressing, the convex/curved graphite plunger 501 will have much less shrinkage due to the smaller CTE while the mortar material 503 surrounding the convex/curved plunger will have a much larger shrinkage. When all parts are cooled to room temperature, a large hoop compressed stress (e.g., Hoop compression in FIG. 5) was exerted onto the convex/curve graphite plunger 501 by the surrounding mortar material 503 while a large hoop tensile stress (e.g., Hoop tension in FIG. 5) was exerted onto the surrounding material 503 by the convex/curved graphite plunger 501. The graphite plunger 501 can withstand the large hoop compressive stress without a major problem. In contrast, since the convex/curved graphite plunger 501 is sitting inside the surrounding material 503 and is blocking the surrounding material 503 from further shrinkage, the surrounding mortar material 503 has no way to shrink other than cracking to relieve the large hoop tensile stress (e.g., Hoop tension in FIG. 5) exerted by the concaved/curved graphite plunger 501.

This thin shell mortar 503 is a typical example and the same large hoop tensile stress can be developed for any other complicated shape such as a hollow cylinder, conical shape, rectangular cavity shape, crucible, pyramid, and the like. In order to advance to near-net-shape hot pressing technology, a transformational and revolutionary concept is needed to overcome the large hoop tension exertion on the surrounding material (e.g., 503) by the concaved/curved graphite top plunger (e.g., 501).

FIGS. 6A, 6B, 6C, 6D, 6E, and 6F depict an example pseudo-hot-isostatic-pressing, in accordance with embodiments herein, in an example sequence. FIG. 6G summarizes the overall example pseudo-hot-isostatic pressing, in accordance with embodiments herein.

Figure 6A:
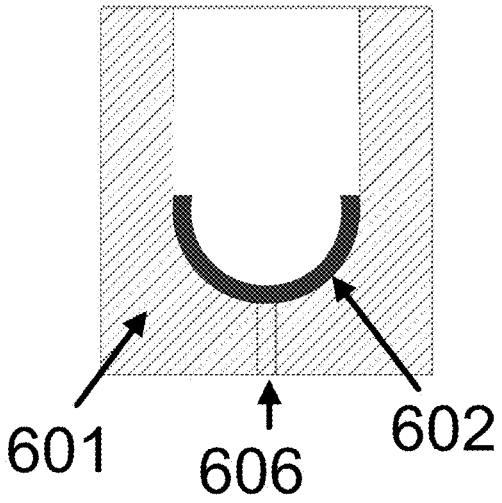

With reference to FIG. 6A, a graphite pin 606 can be adhered (e.g., glued) to the cavity of graphite die 601. In embodiments, the graphite pin 606 can be used to eject a final component 602 after pseudo-hot-isostatic-pressing is completed. In example embodiments, a powder pre-form can be formed into the graphite die 601 with the desired shape using any reasonable material such as aluminum, steel, or graphite punch.

Figure 6B:
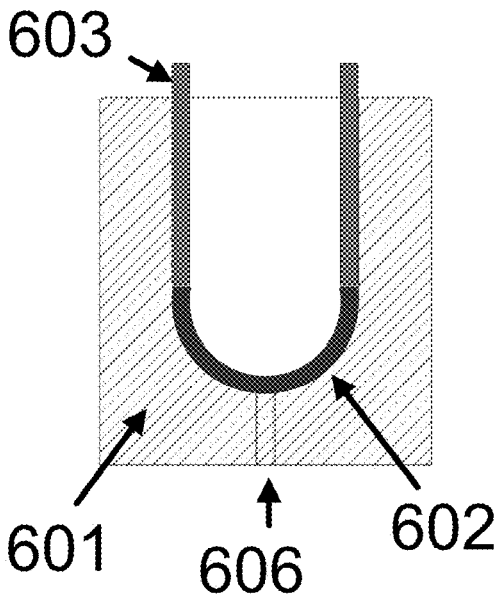

With reference to FIG. 6B, after the pre-form is completed, a graphite sleeve 603 can then be inserted into graphite die 601 until a lower surface of the graphite sleeve 603 contacts an upper (or top surface) of the pre-form (e.g. what resulted in the component 602).

Figure 6C:
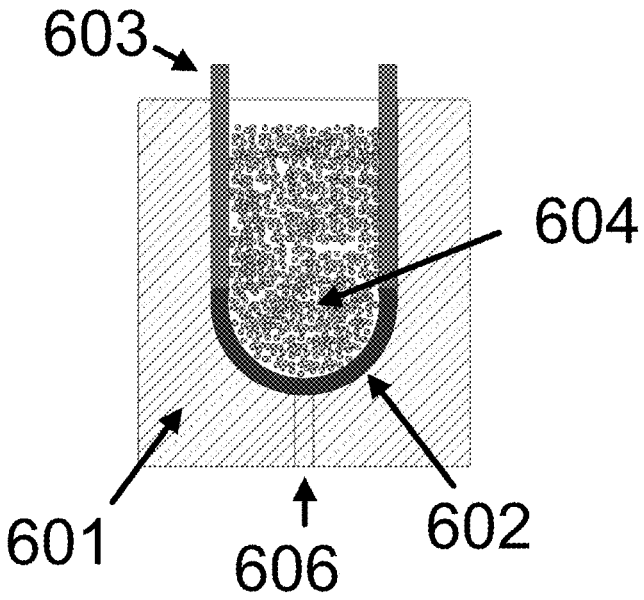

With reference to FIG. 6C, graphite flake or hexagonal boron nitride 604 can then be loaded into the cavity of the graphite die 601. As shown in FIG. 6C, the graphite flake or hexagonal boron nitride 604 fills the cavity and is in contact with the pre-form (e.g., what results in the final component 602 after pressing).

Figure 6D:
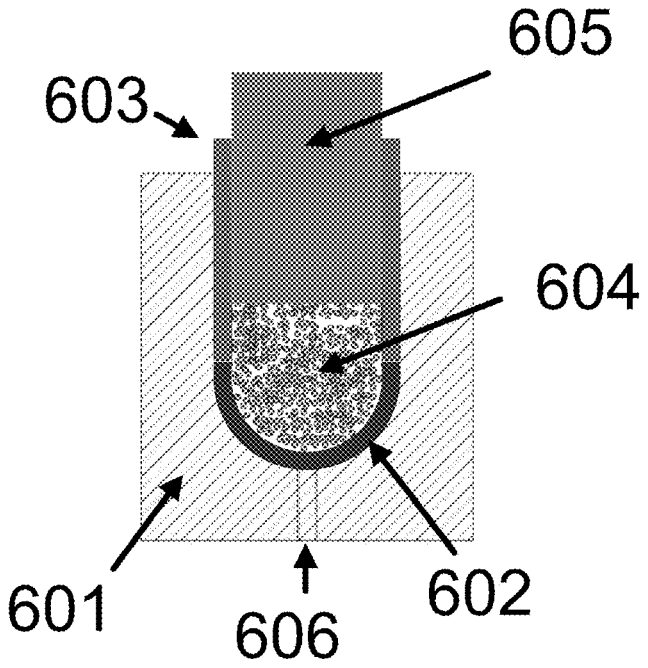
Figure 6E:
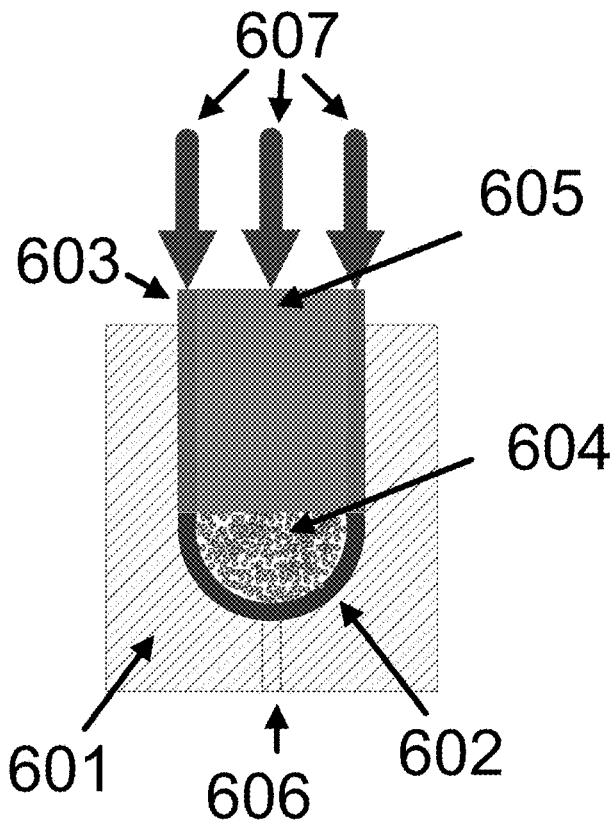

With reference to FIG. 6D, a graphite punch 605 can then be inserted into the cavity of the graphite sleeve 603. The graphic punch 605 can then be used to press down (e.g., compress) the graphite flake or hexagonal boron nitride 604 toward the pre-form (e.g., what results in 602). It will be appreciated that, in embodiments, the graphite punch 605 has an equivalent height as that of the graphite sleeve 603. When the graphite punch 605 has an equivalent height as that of the graphite sleeve 603, the graphite punch 605 and the graphite sleeve 603 can eventually become flush with one another (e.g., at an upper surface of each of the graphite punch 605 and the graphite sleeve 603) and then further pressed down (e.g., see force 607) after becoming flush as shown in FIG. 6E.

Figure 6F:
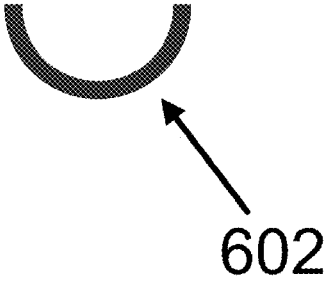
Figure 6G:
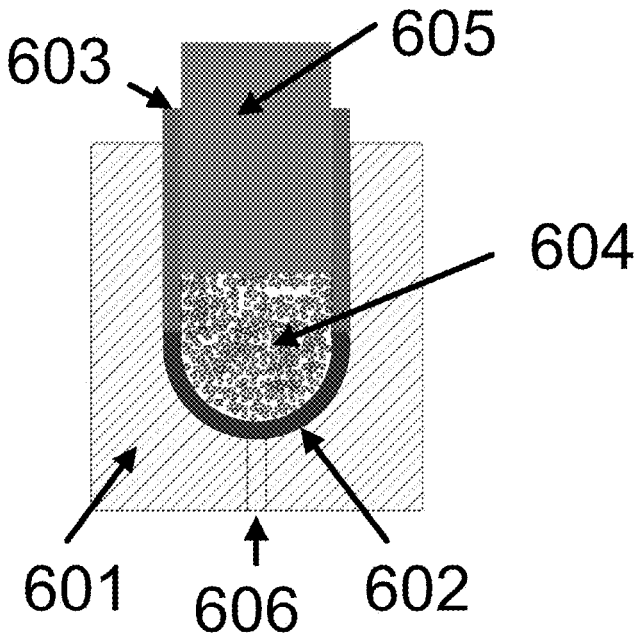

After pseudo-hot-isostatic-pressing is completed, the graphite punch 605 can be removed followed by the graphite sleeve 603. The component 602 with graphite flake or hexagonal boron nitride 604 can then be ejected by pushing the graphite pin 606 upward from the bottom of the graphite die 602. The graphite flake or hexagonal boron nitride 604 can be easily removed by using a Dremel tool, sandblasting, or other appropriate means. FIG. 6F depicts an example final pseudo-hot-isostatic-pressed component 602 once the remaining components of the process have been removed.

FIG. 6G summarizes the example pseudo-hot-isostatic-pressing method and system 600 depicted in FIGS. 6A-6F, according to embodiments of the present disclosure. Shown in FIG. 6G (and explained above with respect to FIGS. 6A-6F), the graphite die 601 (e.g., the graphite die 601 may be a continuous component that is cylindrical) is first loaded with ceramic or metal powders to ultimately form a desired shape (e.g., the desired shape of the graphite die 601 so that material loaded into the graphite die 601 may result in such a desired shape) using an aluminum mandrel or any other appropriate method for the present disclosure. After the desired shape of the graphite die 601 is formed, a graphite sleeve 603 (e.g., the sleeve continues within the graphite die 601) is then loaded into the cavity until it reaches the desired shape 601. Then, a solid lubricant (e.g., graphite flake or boron nitride powder) 604 is filled to a desired level (e.g., depending on the desired shape for the resulting part). A flat end graphite plunger 605 is then inserted the cavity to reach the top of graphite flake or boron nitride powder 604.

It will be appreciated that embodiments herein use a sleeve (e.g., graphite sleeve 603) to facilitate control of a width and/or thickness of one or more portions of the resulting part.

It will be appreciated that embodiments herein utilize a flat top plunger as shown in FIG. 6 instead of a convex/curved plunger. In embodiments herein, the function of the convex/curved portion (e.g., of the plunger 501, 101) is replaced by the innovative solid lubricant (e.g., graphite flake or hexagonal boron nitride powder) 604. While the graphite plunger 605 is rigid and inflexible, the graphite flake or hexagonal boron nitride powder is flexible and can be moved from high stress areas to low stress areas, which indirectly applies the stress uniformly against the curved surface of the mortar 602 during hot pressing at a desired temperature. That is, external pressure is uniaxially applied from top and bottom to the mortar 602 using the die 601, plunger 605, and the solid lubricant 604.

Also shown in FIG. 6G, the system 600 includes a pin 606 in the base of the graphite die 606. The pin 606 enables easy removal of the finished mortar 602 after the mortar 602 has been pseudo-hot-isostatic-pressed into the desired shape. It will be appreciated that the pin 606, when in place during the hot pressing of the mortar 602, provides a surface that is flush with a surface of the surrounding graphite die 601. Accordingly, the pin 606 does not introduce undesired artifacts by way of its presence during the hot pressing, but also enables an easy method of removing the resulting part 602 from the graphite die 601 (e.g., as opposed to using a cumbersome method or equipment for removal from the die 601). In embodiments, the pin 606 is also made of the same material(s) as the die 601; this ensures there are no undesired artifacts introduced by differences in CTE or other properties of materials that could exist if the pin 606 and die 601 were made from different materials. It will be appreciated that the pin 606 can be used to push the mortar 602 up and out of the die 601 (e.g., in an upward direction or direction away from the pin 606 that appears to be in the base of the die 601).

It will be appreciated that embodiments herein utilize a graphite sleeve 603 that may be the same height as the flat end graphite plunger 605. Such a feature reduces manufacturing complexity as well as uncertainty with regard to placement of the graphite sleeve 603, the graphite plunger 605, and the placement of the components in relation to one another.

It will further be appreciated that embodiments herein may refer to the system and method depicted in FIG. 6G as a pseudo-isostatic-hot-pressing system; this is because graphite is a solid media and is not a gas media. In embodiments herein, the amount of graphite flakes or boron nitride powders (e.g., or other appropriate solid lubricant) needed to fill up the cavity (e.g., within graphite die 601) under pressure will be calculated based on the volume of the cavity and the compacted graphite (e.g., die 601) density, which can be, for example, about 90% dense (e.g., 10% pore) after pseudo-hot-isostatic-pressing. This volume can be multiplied by the density of graphite or boron nitride (e.g., or other appropriate solid lubricant) to obtain the total weight that is required for the top flat plunger (e.g., 605) to reach the same level as that of graphite sleeve (e.g., 603). Since 90% may be the estimated pressed density, a few iterations of such calculations may provide for optimizing (e.g., minimizing) the amount of the total graphite flakes or boron nitride powder that is needed. As indicated in FIG. 6G, the pseudo-isostatic-hot-pressing will perform at the desired temperature at targeted pressure because the graphite flake or hexagonal boron nitride can withstand up to 3000° C. (e.g., above 300° C.) and can still be removed easily thereafter.

FIG. 7 depicts a boron carbide mortar, manufactured in accordance with embodiments herein, that is free from cracks or other defects that would have been introduced as a result of using a conventional manufacturing method. That is, the mortar depicted in FIG. 7 was formed using boron carbide powder as the original material for the mortar.

FIG. 8 depicts an aluminum nitride mortar, manufactured in accordance with embodiments herein, that is free from cracks or other defects that would have been introduced as a result of using a conventional manufacturing method. The mortar depicted in FIG. 8 was formed using aluminum nitride powder as the original material for the mortar.

FIG. 9 depicts an aluminum oxide mortar, manufactured in accordance with embodiments herein, that is free from cracks or other defects that would have been introduced as a result of using a conventional manufacturing method. The mortar depicted in FIG. 9 was formed using aluminum oxide powder as the original material for the mortar.

FIG. 10 depicts a silicon carbide crucible, manufactured in accordance with embodiments herein, that is free from cracks or other defects that would have been introduced as a result of using a conventional manufacturing method. The mortar depicted in FIG. 10 was formed using silicon carbide powder as the original material for the mortar.

FIG. 11 depicts a zirconium carbide heat shield, manufactured in accordance with embodiments herein, that is free from cracks or other defects that would have been introduced as a result of using a conventional manufacturing method. The mortar depicted in FIG. 11 was formed using zirconium carbide powder as the original material for the mortar.

Example embodiments and variations are described below.

In various embodiments, a method of manufacturing a part includes positioning a material within a cavity of a die, positioning solid lubricant within the cavity of the die between a surface of a plunging component and the material, and uniaxially applying pressure to the material with the plunging component via the solid lubricant until the material forms a desired shape.

In some of these embodiments, the solid lubricant is configured to, responsive to the pressure, substantially uniformly distribute stress generated by the pressure to the material.

In some of these embodiments, the solid lubricant flexibly moves from high stress areas to low stress areas to substantially uniformly distribute stress generated by the pressure to the material.

In some of these embodiments, the die comprises rigid graphite. In some of these embodiments, the plunging component comprises rigid graphite. In some of these embodiments, the solid lubricant comprises one or more of ceramic powder, graphite flakes, boron nitride powder, or metal powder.

In some of these embodiments, the method further includes, prior to positioning the solid lubricant, forming the die into the desired shape such that the die defines the cavity with the desired shape, and loading a sleeve into the cavity of the die along an interior surface of the die that defines the cavity until a distal end of the sleeve contacts the material. In some of these embodiments, positioning the solid lubricant includes filling the cavity of the die with the solid lubricant up to a desired level, and inserting the plunging component into the cavity until the surface of the plunging component reaches an upper surface of the solid lubricant.

In some of these embodiments, the pressure is applied at a pressure level and a temperature level. In some of these embodiments, the temperature level is above 300° C. In some of these embodiments, the pressure level is greater than 10 Pound per Square Inch (PSI).

In some of these embodiments, the method further includes, upon completion of the material forming the desired shape, removing, using a pin embedded in a base of the cavity of the die, the material from the die. In some of these embodiments, the pin comprises a same material as the die. In some of these embodiments, a base surface of the base is flush with the pin when the pin is embedded in the base of the die. In some of these embodiments, removing the material, using the pin, comprises advancing the pin in a direction away from the base of the die.

In some of these embodiments, the sleeve comprises a first height and the plunging component comprises a second height. In some of these embodiments, the first height and second height are equal.

In some of these embodiments, the material comprises one or more of silicon carbide powder or aluminum nitride powder. In some of these embodiments, the solid lubricant comprises flakes. In some of these embodiments, the flakes comprise a size in a range of 1 micron to 1 centimeter. In some of these embodiments, the material comprises one or more of ceramic, metal, or composite materials. In some of these embodiments, the ceramic materials comprise one or more of oxide, carbide, nitride, oxynitride, oxycarbide, sulfide, phosphate, halide, or composite ceramic materials. In some of these embodiments, the metal materials comprise one or more of pure metal, alloy, or composite metal materials. In some of these embodiments, the material forming the desired shape results in one or more of a mortar, a bowl, a rectangular bowl, or a hollow pyramid.

In some embodiments, a system includes material positioned within a die, and a plunging component configured to uniaxially apply pressure to solid lubricant positioned between a surface of the plunging component and the material. In some of these embodiments, the system further includes a sleeve configured to facilitate control of one or more of a width or thickness of one or more portions of the material. In some of these embodiments, the material is configured to form a desired shape of the die responsive to the uniaxially applied pressure. In some of these embodiments, the solid lubricant is configured to, responsive to the uniaxially applied pressure, substantially uniformly distribute stress generated by the pressure to a first upper surface of the material.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a part, the method comprising:

positioning a first material within a cavity of a die such that the first material is in contact with a first surface of a base of the die;

positioning a stress transmitting material within the cavity of the die between a surface of a plunging component and the first material; and uniaxially applying pressure to the first material with the plunging component via the stress transmitting material until the first material forms a desired shape, wherein the stress transmitting material is configured to change shape in response to the pressure from the plunging component as it transmits substantially uniformly distributed force to the first material.

2. The method of claim 1, wherein the stress transmitting material is configured to, responsive to the pressure, transmit the substantially uniformly distributed force generated by the pressure to the first material while simultaneously relieving stress on the first material as a result of the pressure.

3. The method of claim 1, wherein the stress transmitting material flexibly moves from high stress areas to low stress areas to transmit the substantially uniformly distributed force generated by the pressure to the first material while simultaneously relieving stress on the first material as a result of the pressure.

4. The method of claim 1, wherein the die comprises rigid graphite.

5. The method of claim 1, wherein the plunging component comprises rigid graphite.

6. The method of claim 1, wherein the stress transmitting material comprises one or more or ceramic powder, graphite flakes, boron nitride powder, or metal powder.

7. The method of claim 1, further comprising, prior to positioning the stress transmitting material:

forming the die into the desired shape such that the die defines the cavity with the desired shape; and loading a sleeve into the cavity of the die along an interior surface of the die that defines the cavity until a distal end of the sleeve contacts the first material.

8. The method of claim 7, wherein positioning the stress transmitting material comprises:

filling the cavity of the die with the stress transmitting material up to a desired level; and inserting the plunging component into the cavity until the surface of the plunging component reaches an upper surface of the stress transmitting material.

9. The method of claim 1, wherein the pressure is applied at a pressure level and a temperature level.

10. The method of claim 9, wherein the temperature level is above 300° C.

11. The method of claim 1, further comprising:

upon completion of the first material forming the desired shape, removing, using a pin embedded in the base of the cavity of the die, the first material from the die.

12. The method of claim 11, wherein the pin comprises a same material as the die.

13. The method of claim 11, wherein a base surface of the base is flush with the pin when the pin is embedded in the base of the die.

14. The method of claim 11, wherein removing the first material, using the pin, comprises advancing the pin in a direction away from the base of the die.

15. The method of claim 7, wherein the sleeve comprises a first height and the plunging component comprises a second height.

16. The method of claim 15, wherein the first height and second height are equal.

17. The method of claim 1, wherein the first material comprises one or more of aluminum oxide, silicon carbide, zirconium carbide, or aluminum nitride powder.

18. The method of claim 1, wherein the stress transmitting material comprises flakes.

19. The method of claim 18, wherein the flakes comprise a size in a range of 1 micron to 1 centimeter.

20. The method of claim 9, wherein the pressure level is greater than 10 PSI.

21. The method of claim 1, wherein the first material comprises one or more of ceramic, metal, or composite materials.

22. The method of claim 21, wherein the ceramic materials comprise one or more of oxide, carbide, nitride, oxynitride, oxycarbide, sulfide, phosphate, halide, or composite ceramic materials.

23. The method of claim 21, wherein the metal materials comprise one or more of pure metal, alloy, or composite metal materials.

24. The method of claim 1, wherein the first material forming the desired shape results in one or more of a mortar, a bowl, a rectangular bowl, or a hollow pyramid.

25. The method of claim 1, further comprising:

subsequent to the uniaxially applying pressure to the first material with the plunging component via the stress transmitting material until the first material forms the desired shape, removing the stress transmitting material from the cavity of the die.

* * * * *